US006467857B2

(12) United States Patent
Hakemann

(10) Patent No.: US 6,467,857 B2
(45) Date of Patent: Oct. 22, 2002

(54) SALES COUNTER WITH A CLOSURE FOR CLOSING A MERCHANDISE COMPARTMENT

(76) Inventor: Fritz Hakemann, Barnstorfer Strasse 27, D-49424 Goldenstedt (DE)

( * ) Notice: Subject to any disclaimer, the term of this patent is extended or adjusted under 35 U.S.C. 154(b) by 0 days.

(21) Appl. No.: 09/818,248

(22) Filed: Mar. 27, 2001

(65) Prior Publication Data

US 2001/0026115 A1 Oct. 4, 2001

(30) Foreign Application Priority Data

Mar. 29, 2000 (DE) ..... 200 05 833 U

(51) Int. Cl.[7] ..... A47F 3/00
(52) U.S. Cl. ..... 312/138.1; 312/140; 16/355
(58) Field of Search ..... 312/137, 138.1, 312/140, 327, 328, 351, 140.1, 140.2, 140.3, 140.4; 108/27, 108; 16/355; 40/574; 248/291.1

(56) References Cited

U.S. PATENT DOCUMENTS 846,343 A * 3/1907 Plym ..... 312/140
1,738,259 A 12/1929 Newlander
2,652,305 A 9/1953 Swedman et al.
3,663,990 A * 5/1972 Shane ..... 16/355
4,500,147 A * 2/1985 Reister ..... 312/328 X
4,682,825 A * 7/1987 Crosslen
4,708,409 A * 11/1987 Voegeli ..... 312/138.1

FOREIGN PATENT DOCUMENTS

DE 1957476 * 3/1967
DE 91 13 517 2/1992
DE 93 02 448 2/1994
DE 94 09 311 7/1994

* cited by examiner

*Primary Examiner*—Janet M. Wilkens
(74) *Attorney, Agent, or Firm*—Collard & Roe, P.C.

(57) ABSTRACT

A sales counter has at least one merchandise compartment for keeping merchandise ready to be sold. The opening of the merchandise compartment is equipped on the service side with a board-like closing element which can be actuated, and which is engaged via at least one component located along one of its longitudinal edges. There is at least one associated, stationary component holder along an edge of the service-side opening. Each closing element comprises a flap element, whereby a component of the flap element is offset by a predetermined measure toward the service side versus the plane of the flap.

15 Claims, 1 Drawing Sheet

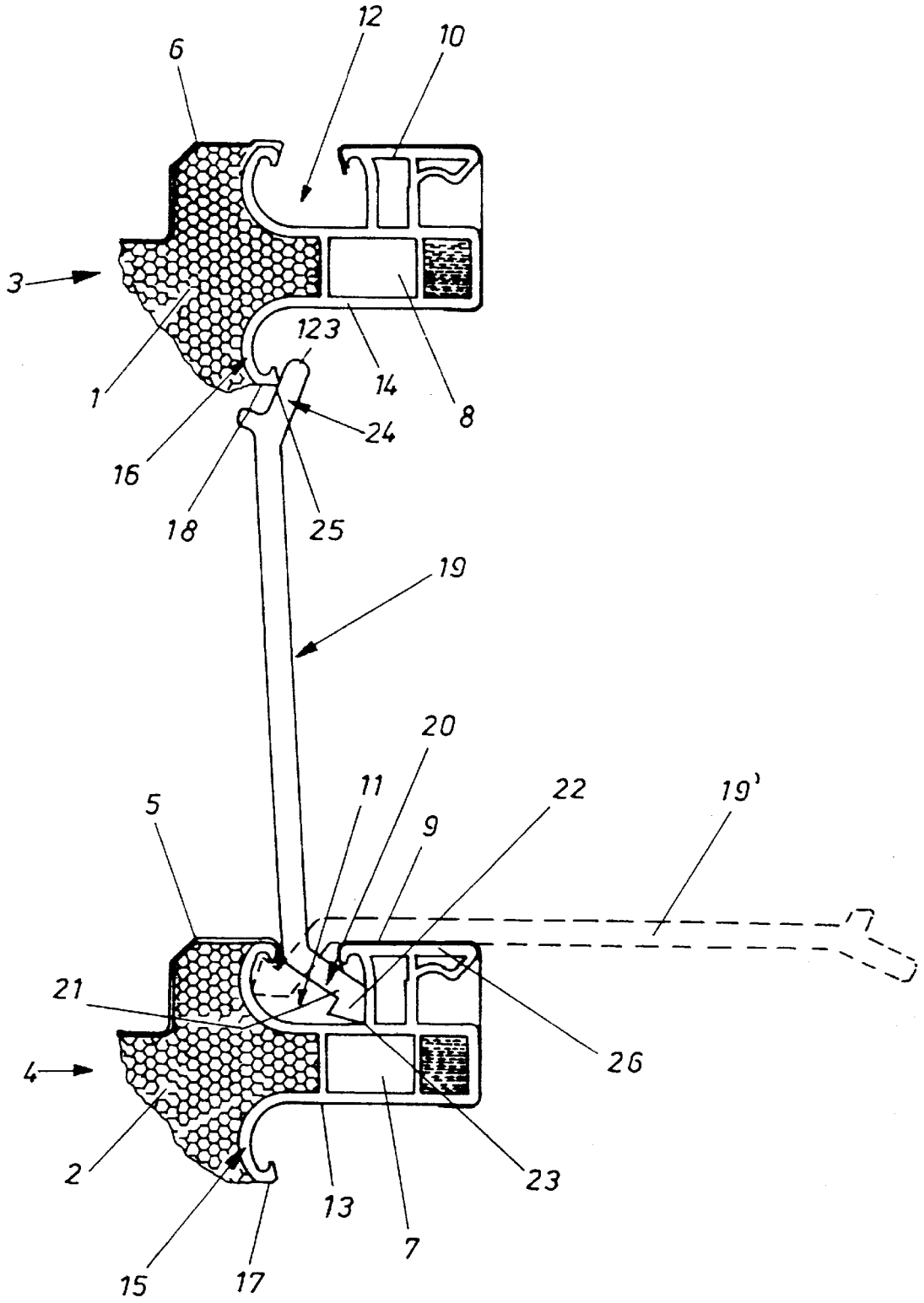
12
10
6
3
123
14
8
1
24
16
18
25
19
20
11
22
19'
5
9
21
26
4
2
23
13
7
15
17

SALES COUNTER WITH A CLOSURE FOR CLOSING A MERCHANDISE COMPARTMENT

BACKGROUND OF THE INVENTION

1. Field of the Invention

The invention relates to a sales counter with at least one merchandise compartment or shelf for keeping merchandise ready to be sold. The opening of the compartment located on the sales person's or service side is equipped with an actuated, plate-like closure. There is at least one component that is located along one of the longitudinal edges of the plate-like closure. The closure is engaged by at least one associated, stationary component holder located near an edge of the opening.

2. The Prior Art

Sales counters are pieces of furniture similar to cupboards or display cases, and are normally set up in sales rooms to divide it into a customer side and a service side. The customers present on the customer side can instruct the sales personnel working on the service side which merchandise is desired. The sales person then actuates a closure or door of the respective merchandise compartment in order to open it, takes out the merchandise, closes the merchandise compartment again, and subsequently packages the merchandise, hands it to the customer, and possibly also acts as the cashier.

Modern sales counters, in particular sales counters for fresh merchandise such as bread and pastries, are designed in the form of a display case, i.e. they have glass walls on the customer side in most cases, through which the merchandise displayed in the merchandise compartments can be viewed and selected by the customer.

Fresh goods require cooling in most cases. Baked goods such as pastries have to be cooled as well so that the drying-out process can be slowed down, and ornaments and coatings made of chocolate or sugar will not run or melt.

Sales counters are furniture items which are set up in the sales room more or less freely, and in which a complete cooling device is therefore installed in most cases. The cooling equipment is thus a component of the sales counter. The designated purpose of a sales counter is to receive and display merchandise, and the installations required in the sales counter for cooling purposes should require as little installation space as possible. Cooling devices for sales counters therefore do not always have the cooling capacity that would be actually required for adequately cooling the merchandise. This applies in particular to sales counters that are open on the service side. Such sales counters do offer the advantage that the merchandise can be placed in and removed from the merchandise compartments (or shelves) easily by the sales persons. However, such sales counters require high cooling capacities. open sales counters pose the additional problem that if adequate cooling capacity were available, condensation of air humidity may very quickly cause undesired icing of those areas of the sales counter that assume temperatures within near or at the frost limit because of temperature drops, which are unavoidable in the cooling process.

Furthermore, to obtain easy access to the merchandise in the individual merchandise compartments from the service side, increased operating costs are incurred for cooling.

It is known to equip the merchandise compartments of a sales counter with plate-like closures in order to be able to manage with lower cooling capacities. The merchandise compartments are in this way "bulkheaded" against the environment of the sales counter. The sales person can gain access to the desired merchandise compartment by opening the closure by hand as required before and after the merchandise has been removed.

If the time periods for keeping the merchandise compartment open are to be as short as possible, which would be useful for optimal cooling, the actuation process, i.e. the steps for opening and closing the merchandise compartment have to be carried out twice even for the same type of merchandise if it cannot be removed individually, but if a tray with individual pieces of merchandise needs to be removed from the merchandise compartment. After the closure has been actuated the first time, and the tray has subsequently been removed from the open merchandise compartment, the closure is actuated again in order to close the merchandise compartment. The sale of the merchandise from the tray can then be handled outside of the sales counter. Thereafter, the closure is then actuated a third time in order to open the merchandise compartment again, so that the tray with remaining pieces of merchandise can be pushed again into the merchandise compartment. The closure is then actuated a fourth time after the tray or the pieces of merchandise located on the tray is put back into the merchandise compartment.

These steps are repeated while the goods are sold in a retail store, for example in a bakery shop, for each piece of merchandise sold, whereby the sales person often also has to successively actuate for one customer several closures of several merchandise compartments holding different types of goods. The process of actuating the closures of the merchandise compartments therefore represents considerable part of the working hours of the sales person.

The customer expects to be serviced in the shortest possible time. It is also in the interest of the sales person to service the customer as quickly as possible so that as much merchandise as possible can be sold in the shortest possible time.

SUMMARY OF THE INVENTION

It is therefore an object of the invention to provide a sales counter whose merchandise compartments are equipped with closures that can be actuated in order to consume as little cooling energy as possible, and where the actuation of the plate-like closures is easy, uncomplicated and therefore possible in a particularly rapid manner.

This object is accomplished in that each closure is realized in the form of a flap element, and a component of the flap element is offset by a predetermined measure against the plane of the flap, preferably toward the service side.

In conjunction with the sales counter as defined by the invention, each flap element is therefore a simple, one-piece plate element that can be folded around an axis that is defined by a stationary component holder and therefore by the component of the flap element that is actively connected with the component holder. The plate forming the flap element has a point of gravity, and because the component is a means of the folding joint that is offset against the plane of the flap, the flap element generates in predetermined folding positions a moment that folds the flap elements either into the position closing the merchandise compartment, or in a position opening the merchandise compartment. Therefore, owing to its own weight, the flap element either drops into the opening or closing position as soon as it is moved beyond a folding position conforming to a vertical plane extending through the folding axis. This component represents the function of a folding joint. Since the component is offset against the folding plane toward the service side, the flap element will preferably automatically drop in a final folding, i.e. opening or closing position as soon as the folding movement of the flap element is no longer manually influenced by the sales person.

The component acting as the means of a folding joint, with which the flap element is equipped, may be attached to or molded onto the flap element, which can be in the form of a plate. In conjunction with the sales counter as defined by the invention, the component preferably is a segment of the flap that is bent off from the plane of the flap at a predetermined angle. The angle of the bend may amount to, for example 45°, The angle is, of course, dependent upon the dimensions of the flap element or the width of the bent segment of the flap. With a wide section of the flap, an adequate offset can be obtained with a more obtuse angle as well. The greatest possible offset is obtained with a narrow, bent plate segment bent off by an angle of about 90°.

According to a particularly simple embodiment of the invention, which is useful for simple handling of the flap element as well, each component holder is a recess located on the edge that defines the opening at the bottom on the service side. The lower free edge of the flap element or bent flap segment forming the component can be accommodated in the recess in this way in a standing manner. Special joint components are therefore not required. The flap elements are inserted or the sales counter is equipped with the flap elements by simply setting up each flap element with its lower longitudinal edge in the respective recess. The width of the recess or the spacing between their opening edges may limit in this connection the final positions of the flap element standing in the recess, so that the flap element, which is merely freely standing in the recess, will not drop out of the recess in the folding position in which the merchandise compartment is opened.

Each flap element can be advantageously cut to size or molded from plastic boards. Acrylic glass is suitable for the flap elements of the type of sales counter here under discussion because of its transparency.

It is particularly advantageous if the flap element has a stop along its second longitudinal edge with which it rests against an associated stationary support component in a folding position to close merchandise compartment. The support component is located on the top edge of the opening on the service side. By offsetting the lower segment of the flap element, which forms the component participating in the function of a folding joint, the flap element standing in the recess is capable of dropping into a folding position closing the merchandise compartment as soon as the line on which it is standing in the recess is offset versus a vertical plane by gravity toward the service side. The flap element thus describes a folding path leading into the closing folding position until it comes to rest against the support component with its stop.

The support component is located along the edge defining the opening at the top on the service side, so that the flap element standing in the recess will retain the closing folding position. The stop is offset versus the plane of the flap element toward the service side.

The flap segment participating in the folding joint ends in a foot strip with a wedge-shaped cross section. The point of the wedge corresponds with the lower free edge of the flap element. The flap element is standing in the recess with the edge.

The one-piece flap element, where all functional components are formed by segments of the flap, can be removed as one unit from the sales counter at any time, for example for cleaning. Following cleaning, each flap element can be attached again to the sales counter by simply setting it up again in the recesses without any special re-assembly work.

Such an embodiment of the sales counter facilitates for the sales personnel secondary activities associated with the sales work as well.

Equipping the sales counter with corresponding fittings for the closable openings on the service side can be omitted if the sales counter is equipped with sections framing the edges of the opening on the service side. Each section can be simply joined with the sales counter by providing it with a shape permitting such a section to be attached in front of the bottom of a merchandise compartment in a form-locked manner. On a first section surface extending in a plane approximately parallel with the bottom of the compartment, each section has component holders, and support components on an opposite second surface of the section. The sections may be extruded or drawn hollow sections made of plastic or metal.

Each component holder has a recess in the form of a longitudinal groove provided in the respective surface of the section. The edges of the section forming the opening edge of the groove are advantageously rounded off, so that the flap element, which is received in the longitudinal groove with its lower, offset longitudinal edge, can easily roll off on the edges when it is pivoted into different folding positions.

Each support component is preferably molded onto or shaped on a section and is in the form of a longitudinal strip projecting from the respective surface of the section. The longitudinal strip may have any desired cross section and can be arranged on the section in such a way that it promotes holding of the flap element in the closing end position of the flap because of the weight of the flap element engaging in the point of gravity. Like the component participating in the function of a folding joint, the stop of the flap element that can be actively connected with the support component is a second segment of the flap as well. This second segment is located along the second upper longitudinal edge.

The second segment of the flap forming the stop, like the first segment of the flap forming the component, is bent off by a predetermined angle in relation to the plane of the flap as well. The arrangement on the flap element is made in such a way that the flap segments associated with the first and the second longitudinal edges are bent off toward the same side of the flap elements. These measures, while maintaining the advantage of a one-piece flap element, also promote the effect that the flap element will drop by itself into its final closing or opening position.

With the sales counter as defined by the invention, the area of the section provided with the longitudinal groove, located on the side of the section facing away from the merchandise compartment, is in the form of a stationary support shoulder for the flap element when the flap element is folded into the open position.

The flap element folded into the open position is held in a horizontal position, so that a support plane is created for the sales personnel when such personnel pulls a tray with merchandise from the sales counter. Such a support plane supports and holds the tray. This substantially facilitates the handling of merchandise. The supported flap element located in the open position replaces a tray support, and sales persons are saved multiple opening and closing operations while merchandise is being requested from the merchandise compartment.

Actuating the flap element for the purpose of opening and closing the merchandise compartments can be carried out in a simple and quick manner with the sales counter as defined by the invention. Sales persons are not required to exercise special care because each flap element always drops into a safe closing or opening position by itself. Furthermore, no special expenditure of force is required because actuation forces, if needed, are supported by the weight of the flap element engaging in the point of gravity of the plate element.

BRIEF DESCRIPTION OF THE DRAWINGS

Other objects and features of the present invention will become apparent from the following detailed description considered in connection with the accompanying drawing. It is to be understood, however, that the drawing is designed as an illustration only and not as a definition of the limits of the invention.

The drawing shows a schematic sectional view of the opening of a sales counter on the service side. The sales counter has several such openings on the service side, located in one or several planes one over the other and among each other. In the exemplified embodiment shown here, the service side of the sales counter is the right-hand edge of the drawing.

DETAILED DESCRIPTION OF THE PREFERRED EMBODIMENT

The drawing shows a sectional view of the edge of the opening of a merchandise compartment on the service side. The opening is defined by an upper edge 1 as well as by a lower edge 2 formed by the front edges of a compartment bottom 3 and 4, respectively, which in turn consists of an insulating layer as well as a metal bottom sheet 5 and 6, respectively. The sections 7, 8 are installed in front of the edges 1, 2 of the opening on the service side, or in front of the edge of a compartment bottom 3 and 4, respectively, conforming to the edges. Each section 7, 8 is an extruded section made of plastic or metal, and has on a first section surface 9 and, respectively, 10 extending in a plane extending about parallel with the bottom of the compartment, a component holder 11 and, respectively, 12 in the form of an undercut longitudinal groove recessed in the respective section surface 10 and, respectively 9. On the opposite second section surface 13 and, respectively 14, there are support components 15 and 16, respectively. Each support component 15, 16 is in the form of a longitudinal strip 17, 18 projecting from the respective section surface 13, 14.

The opening of the sales counter on the service side is equipped with a movable flap element 19 that can be used as the closing element. This closing element has at least one component 20 along one its flap edges or along its first longitudinal edge, which is actively connected at one edge of the opening on the service side with at least one associated, stationary component holder 11 and 12, respectively, in the manner of a folding joint.

Component 20 of flap element 19 is a flap segment 21, which is bent by a predetermined angle in relation to the plane of the flap and ends in a foot strip 22 having an about wedge-shaped cross section. The point of the wedge corresponds with the lower free edge 23 of the flap element. The lower free edge 23 of the flap element 19, or of the flap segment forming the component 20 is received standing in the recess, which is present in the section 8 in the form of a longitudinal groove and forms the component holder 11. Flap element 19 thus is capable of folding about a folding axis formed by the line on which it is standing.

The drawing shows flap element 19 in a folding position in which the sales opening is closed. The upper free edge 123, which corresponds with the second longitudinal edge of flap element 19, is located on a second flap segment 24 which, like the first flap segment 20, is bent by a predetermined angle versus the plane of the flap toward the service side. The second flap segment 24 forms a stop. 25, which comes to rest against the support component 18 of the upper section 8 when the flap element 19 is in the folding position closing the service opening. In this folding position, the weight of the stop 25 pulling on the point of gravity of the flap element retains the stop 25 on the support component 18.

The dashed lines indicate a flap element 19' in a final folding position in which the merchandise compartment is opened and thus accessible from the service side. The area of the section surface 9 of the section 7 having the longitudinal groove 11, which is located on the side facing away from the merchandise compartment, is in the form of a stationary support shoulder 26 for supporting the flap element 19 or 19' when the latter is folded into the open position. In this position, the flap element can be advantageously used as a support surface.

The drawing shows that the two sections 7, 8, by which the edges 1, 2 of the opening of the merchandise compartments are framed particularly at the top and at the bottom, are identical. A flap element of another merchandise compartment of the sales counter adjoining here at the bottom is consequently capable of coming to rest against the support component 17. Another flap element that is associated with another merchandise compartment adjoining at the top, can be inserted in the recess 12 of the upper section 8, the recess being realized in the form of a longitudinal groove.

Accordingly, while only a single embodiment of the present invention has been shown and described, it is obvious that many changes and modifications may be made thereunto without departing from the spirit and scope of the invention.

What is claimed is:

1. A sales counter with at least one merchandise compartment for keeping ready merchandise to be sold, and having an opening on a service side, comprising;

a flap element that can be actuated, said flap element covering the opening of said merchandise compartment;

at least one component located along one longitudinal edge of said flap element and being offset by a predetermined measure versus the plane of the flap element, said component comprising a flap segment bent off by about 45° in relation to the plane of the flap; and at least one associated, stationary component holder disposed along an edge of the opening on the service side for engaging said component.

2. The sales counter according to claim 1, wherein said component is offset toward the service side.

3. The sales counter according to claim 1, wherein each component holder is a recess located along a bottom edge of the opening on the service side.

4. The sales counter according to claim 3, wherein a lower free edge of the flap segment forming the component is received in a standing manner in said recess.

5. The sales counter according to claim 1, wherein the flap segment ends in a foot strip having an approximately wedge-shaped cross section, wherein a point of the wedge corresponds with the lower free edge of the flap element.

6. A sales counter with at least one merchandise compartment for keeping ready merchandise to be sold, and having an opening on a service side, comprising:

a flap element that can be actuated, said flap element covering the opening of said merchandise compartment;

at least one component located along one longitudinal edge of said flap element and being offset by a predetermined measure versus the plane of the flap element; and at least one associated, stationary component holder disposed along an edge of the opening on the service side for engaging said component, wherein said flap element has at least one stop along an upper free edge, said flap element resting via said stop in a folding position closing the merchandise compartment against an associated, stationary support component, said support component being located along a top edge of the opening on the service side.

7. The sales counter according to claim 6, wherein the stop is offset versus the plane of the flap element toward the service side.

8. The sales counter according to claim 6, wherein the stop comprises a second flap segment located along the upper longitudinal edge of said flap element.

9. The sales counter according to claim 8, wherein the second flap segment forming the stop is bent off by a predetermined angle in relation to the plane of the flap.

10. The sales counter according to claim 9, wherein both flap segments are bent off toward the same side of the flap element.

11. A sales counter with at least one merchandise compartment for keeping ready merchandise to be sold, and having an opening on a service side, comprising:

flap element that can be actuated, said flap element covering the opening of said merchandise compartment;

at least one component located along one longitudinal edge of said flap element and being offset by a predetermined measure versus the plane of the flap element; and at least one associated, stationary component holder disposed along an edge of the opening on the service side for engaging said component, wherein edges of the opening are framed by sections and wherein each section is attached to a service-side edge of a bottom of a merchandise compartment, and has component holders on a first surface of the section which extend in a plane approximately parallel with the compartment bottom, and having support components on an opposite second surface of the section.

12. The sales counter according to claim 11, wherein the component holder comprises a longitudinal groove recessed in the first surface of the section.

13. The sales counter according to claim 12, wherein the longitudinal groove is an undercut groove.

14. The sales counter according to claim 12, wherein the area of the section surface provided with the longitudinal groove is in the form of a stationary support shoulder for the flap element when said flap element is folded into an open position.

15. The sales counter according to claim 11, wherein each support component is in the form of a longitudinal strip protruding from the second surface of the section.

* * * * *